US009010082B2

(12) United States Patent
Stoia et al.

(10) Patent No.: US 9,010,082 B2
(45) Date of Patent: Apr. 21, 2015

(54) TURBINE ENGINE AND METHOD FOR FLOWING AIR IN A TURBINE ENGINE

(75) Inventors: Lucas John Stoia, Taylors, SC (US); Patrick Benedict Melton, Horse Shoe, NC (US); Predrag Peja Popovic, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 657 days.

(21) Appl. No.: 13/342,587

(22) Filed: Jan. 3, 2012

(65) Prior Publication Data

US 2013/0167547 A1 Jul. 4, 2013

(51) Int. Cl.
*F23R 3/26* (2006.01)
*F23R 3/04* (2006.01)

(52) U.S. Cl.
CPC .. *F23R 3/045* (2013.01); *F23R 3/26* (2013.01)

(58) Field of Classification Search
CPC ..... F23R 3/04; F23R 3/06; F23R 3/26; F23R 3/045; F23R 3/10
USPC ..... 60/39.23, 760, 240, 39.27, 794, 758
See application file for complete search history.

(56) References Cited

U.S. PATENT DOCUMENTS

| | | | | |
|---|---|---|---|---|
| 3,765,171 | A | 10/1973 | Hagen et al. | |
| 4,255,927 | A * | 3/1981 | Johnson et al. | 60/39.23 |
| 4,353,205 | A * | 10/1982 | Cleary | 60/39.12 |
| 4,387,563 | A | 6/1983 | Bell, III | |
| 4,944,149 | A * | 7/1990 | Kuwata | 60/39.23 |
| 5,197,290 | A | 3/1993 | Lee et al. | |
| 5,351,474 | A | 10/1994 | Slocum et al. | |
| 5,950,417 | A * | 9/1999 | Robertson et al. | 60/776 |
| 6,609,379 | B2 * | 8/2003 | Nagata et al. | 60/773 |
| 6,860,098 | B2 * | 3/2005 | Suenaga et al. | 60/39.23 |

OTHER PUBLICATIONS

Search Report and Written Opinion from EP Application No. 12198016.3 dated Apr. 12, 2013.

* cited by examiner

*Primary Examiner* — Phutthiwat Wongwian
*Assistant Examiner* — Steven Sutherland
(74) *Attorney, Agent, or Firm* — Cantor Colburn LLP

(57) ABSTRACT

According to one aspect of the invention, a gas turbine engine includes a combustor, a fuel nozzle placed in an end of the combustor, and a passage configured to receive an air flow from a compressor discharge casing, wherein the passage directs the air flow into a chamber downstream of the nozzle, wherein a chamber pressure is lower than a compressor discharge casing pressure. The gas turbine engine also includes a flow control device configured to control the air flow from the compressor discharge casing into the passage.

17 Claims, 3 Drawing Sheets

TURBINE ENGINE AND METHOD FOR FLOWING AIR IN A TURBINE ENGINE

BACKGROUND OF THE INVENTION

The subject matter disclosed herein relates to gas turbines. More particularly, the subject matter relates to an assembly of gas turbine stator components.

In a gas turbine engine, a combustor converts chemical energy of a fuel or an air-fuel mixture into thermal energy. The thermal energy is conveyed by a fluid, often air from a compressor, to a turbine where the thermal energy is converted to mechanical energy. During low load or turndown conditions, it is desirable to reduce fuel flow to the turbine engine to reduce consumption. In some cases, however, the amount of fuel supplied to combustors may be limited by a constant flow of oxygen, wherein a certain amount of fuel is necessary to enable clean burning in the combustor.

BRIEF DESCRIPTION OF THE INVENTION

According to one aspect of the invention, a gas turbine engine includes a combustor, a fuel nozzle placed in an end of the combustor, and a passage configured to receive an air flow from a compressor discharge casing, wherein the passage directs the air flow into a chamber downstream of the nozzle, wherein a chamber pressure is lower than a compressor discharge casing pressure. The gas turbine engine also includes a flow control device configured to control the air flow from the compressor discharge casing into the passage.

According to another aspect of the invention, a method for flowing air in a turbine engine includes receiving air in a passage from a compressor discharge casing and directing the air from the passage into a combustion chamber downstream of a combustion region in the combustion chamber. The method also includes controlling a flow of the air into the combustion chamber based on an operating condition of the turbine.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
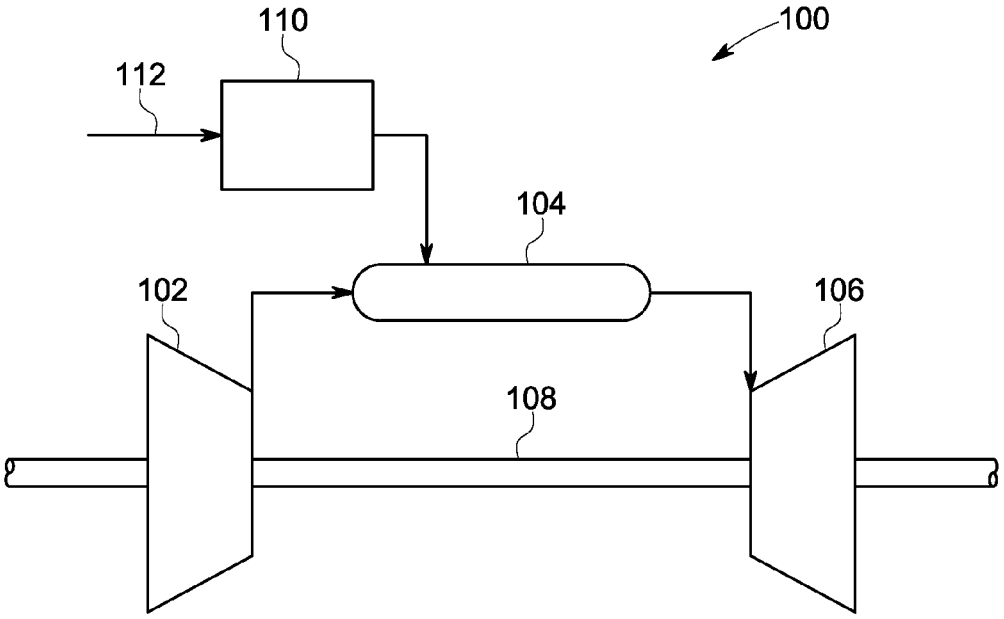
FIG. 1 is a schematic diagram of an embodiment of a gas turbine system.

FIG. 1 is a schematic diagram of an embodiment of a gas turbine system 100. The system 100 includes a compressor 102, a combustor 104, a turbine 106, a shaft 108 and a fuel nozzle 110. In an embodiment, the system 100 may include a plurality of compressors 102, combustors 104, turbines 106, shafts 108 and fuel nozzles 110. The compressor 102 and turbine 106 are coupled by the shaft 108. The shaft 108 may be a single shaft or a plurality of shaft segments coupled together to form shaft 108.

In an aspect, the combustor 104 uses liquid and/or gas fuel, such as natural gas or a hydrogen rich synthetic gas, to run the engine. For example, fuel nozzles 110 are in fluid communication with an air supply and a fuel supply 112. The fuel nozzles 110 create an air-fuel mixture, and discharge the air-fuel mixture into the combustor 104, thereby causing a combustion that heats a pressurized gas. The combustor 104 directs the hot pressurized exhaust gas through a transition piece into a turbine nozzle (or "stage one nozzle") and then a turbine bucket, causing turbine 106 rotation. The rotation of turbine 106 causes the shaft 108 to rotate, thereby compressing the air as it flows into the compressor 102.

In an embodiment, the air received by the fuel nozzles 110 is a portion of the compressed air received from the compressor 102. During a turndown condition, such as during off peak demand, it may be desirable to reduce a fuel flow from the fuel supply 112. In order to meet various emissions and efficiency targets, the amount of air supplied to the fuel nozzles 110 is adjusted based on turbine operating conditions The arrangements discussed below with respect to FIGS. 2-4 provide a variable flow of air supplied to nozzles, thereby enabling fuel flow reduction during turndown conditions.

As used herein, "downstream" and "upstream" are terms that indicate a direction relative to the flow of working fluid through the turbine. As such, the term "downstream" refers to a direction that generally corresponds to the direction of the flow of working fluid, and the term "upstream" generally refers to the direction that is opposite of the direction of flow of working fluid. The term "radial" refers to movement or position perpendicular to an axis or center line. It may be useful to describe parts that are at differing radial positions with regard to an axis. In this case, if a first component resides closer to the axis than a second component, it may be stated herein that the first component is "radially inward" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. Although the following discussion primarily focuses on gas turbines, the concepts discussed are not limited to gas turbines and may apply to other rotating machinery, including steam turbines.

Figure 2:
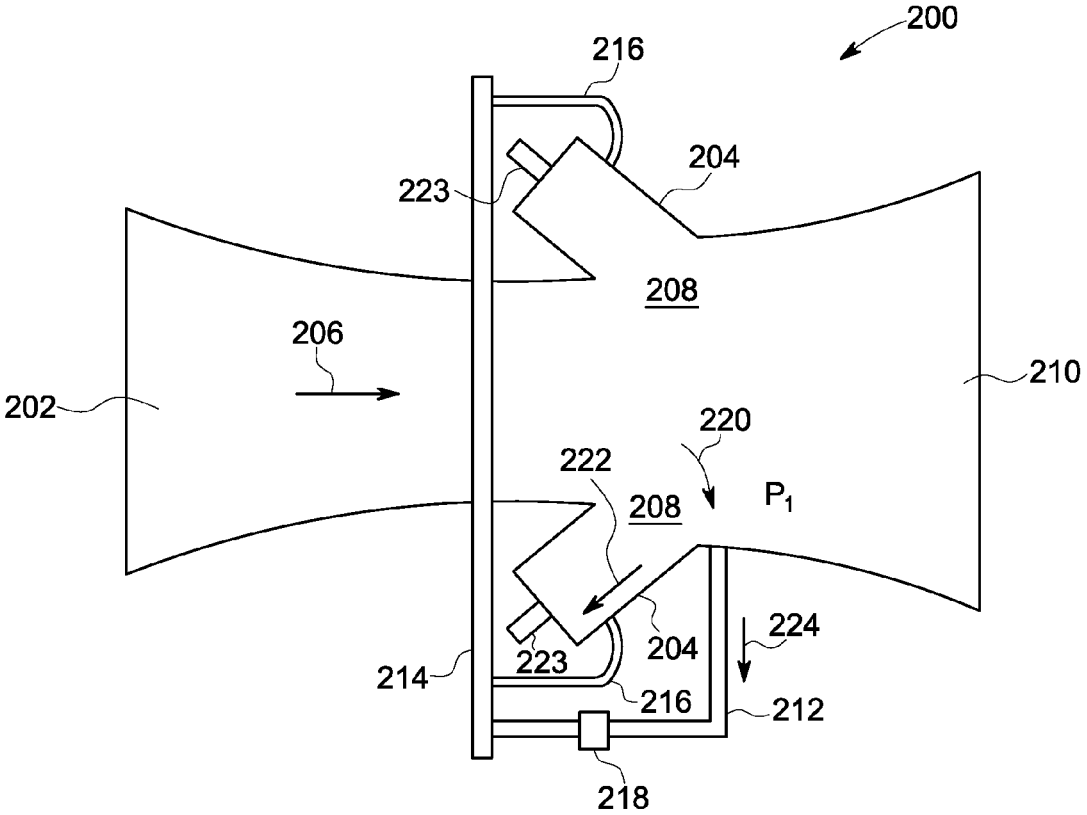
FIG. 2 is a schematic diagram of a portion of another exemplary gas turbine engine.

FIG. 2 is a schematic diagram of a portion of an exemplary gas turbine engine 200. A compressor 202 compresses a fluid, such as air 206, which flows downstream to a compressor discharge casing 208. An air 220 flow (i.e., compressed air) is received by the compressor discharge casing 208, wherein a portion of the received air 220, shown as air 222, is directed to one or more nozzles 223 to be mixed with a fuel for combustion within combustion chambers. The combustion causes a pressurized hot gas to flow into a turbine 210, wherein the hot gas flow across turbine nozzles or blades causes turbine 210 rotation. As depicted, a line or conduit 212 receives a secondary air 224 flow, wherein the secondary air flow 224 is also a portion of the received air flow 220. The conduit 212 may be in fluid communication with a plurality of air bypass passages or injectors (shown in FIGS. 3-4) via conduits 216. Increasing a flow of the secondary air 224 may reduce an amount of air 222 to the fuel nozzles 223 for combustion. A flow control device 218, such as a valve, is configured to selectively enable secondary air 224 to flow through conduit 212, thereby adjusting the amount of air 222 flow received by the fuel nozzles 223 for combustion. A reduced amount of air 222 is caused by increasing secondary air 224 flowing to conduits 216, which is air that does not flow to fuel nozzles 223. A position of the flow control device 218 may be selectively adjusted based on an operation condition (e.g., low load, high load) for the turbine engine 200. When in an open position, the flow control device 218 provides a substantially unrestricted flow of secondary air 224 to a ring manifold 214 or conduit that directs the secondary air 224 to one or more combustors 204 through conduits 216. The conduits 216 are configured to direct the secondary air 224 downstream (with respect to air/fuel flow in combustor 204) of a main combustion region in the combustors 204. The increased and substantially unrestricted air flow of secondary 224 causes a decrease in air supplied to nozzle 223, thereby improving efficiency at turndown. By supplying less air to fuel nozzles 223, a reduced amount of fuel may also be supplied while still enabling efficient combustion with reduced byproducts. Further, compressor 202 airflow is maintained by the depicted arrangement to enhance turbine efficiency. As discussed below, in an embodiment, the conduits 216 direct an adjustable amount of the secondary air 224 to the combustion chambers, wherein the air enters the chambers downstream of fuel nozzles 223.

Figure 3:
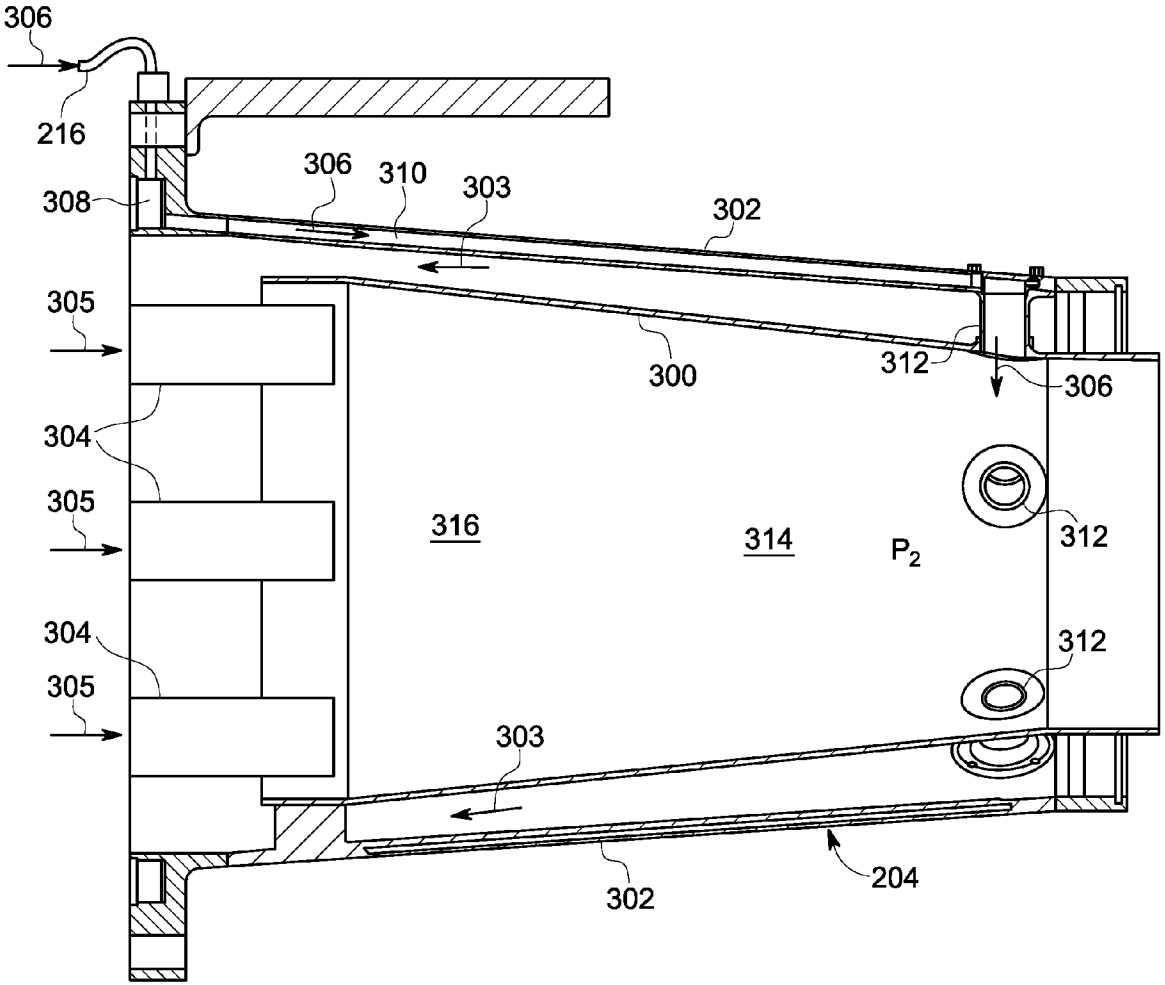
FIG. 3 is a detailed sectional side view of an exemplary combustor.
Figure 4:
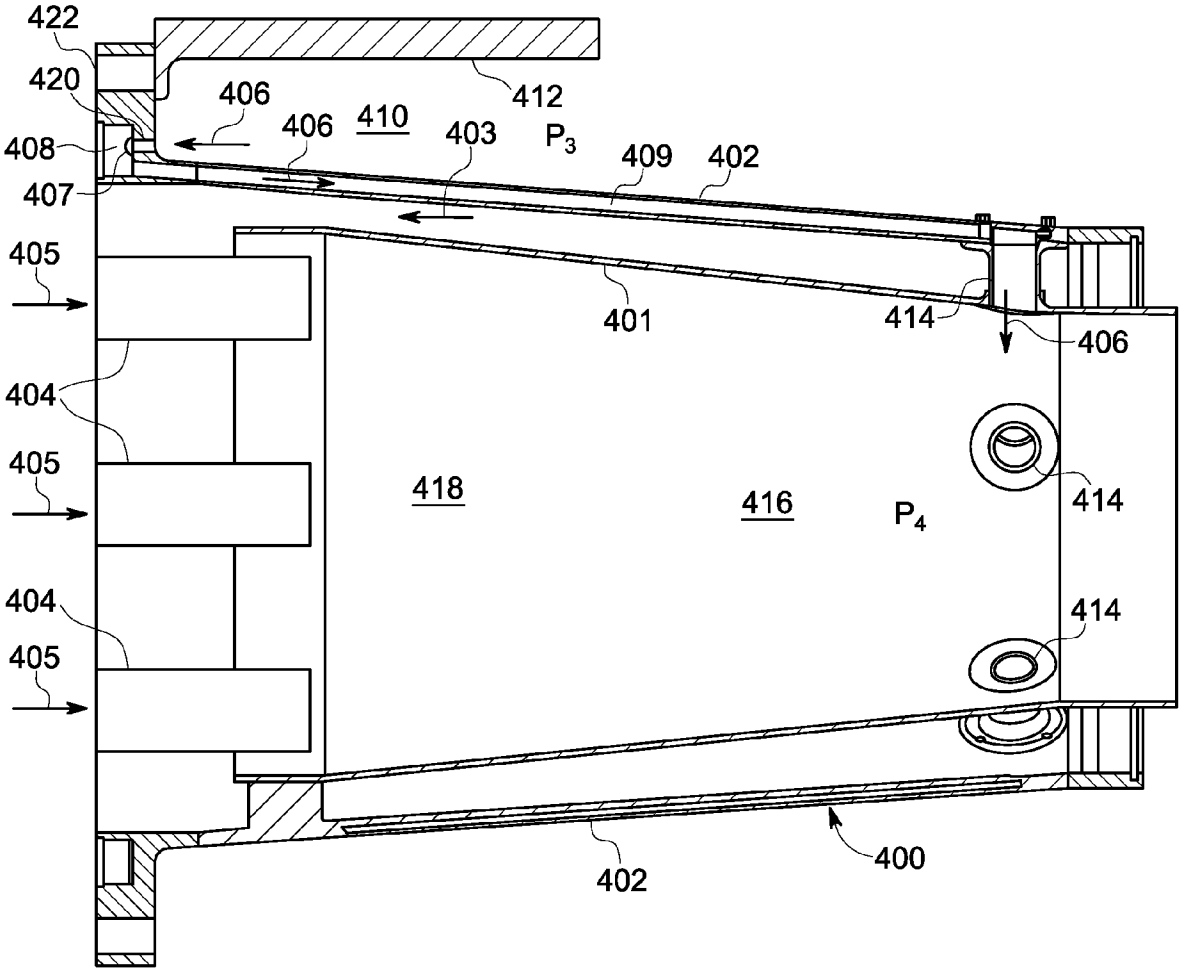
FIG. 4 is a detailed sectional side view of another exemplary combustor.

FIG. 3 is a detailed sectional side view of the exemplary combustor 204. The combustor 204 includes a liner 300 disposed within a flow sleeve 302, wherein air 303 flows along the liner 300 to fuel nozzles 304. The air 303 is received by the fuel nozzles and mixed with a fuel 305 flow. The amount of the air 303 supplied to the fuel nozzles 304 is adjusted by an amount of secondary air 306 flow, wherein the secondary air 306 is received in a chamber 308 from the conduit 216. The secondary air 306 is then directed through a passage 310 in the flow sleeve 302. In an embodiment, the passage 310 is an annular passage formed between two walls that make up the flow sleeve 302. The annular passage 310 enables air flow in a substantially axial direction in the combustor 204. In other embodiments, the passage 310 is a hole or line formed in part of a wall of the flow sleeve 302. The secondary air 306 is directed from the passage 310 into a combustion chamber 314 through injectors 312. The secondary air 306 is received within the combustion chamber 314 downstream of a combustion region 316 proximate the fuel nozzles 304, wherein the secondary air 306 does not substantially affect combustion or combustion byproducts.

The depicted embodiment enables an adjustment of the air 303 supplied to fuel nozzles 304, by changing the amount secondary air 306 flowing through passage 310 and injectors 312. The flow of secondary air 306 from the compressor discharge casing 208 to the combustion chamber 314 is caused by a pressure differential between the regions. Specifically, a pressure in the compressor discharge casing 208, designated as $P_1$, is greater than a pressure $P_2$ in chamber 314. The flow control device 218 controls the amount of secondary air 306 supplied from the compressor discharge casing 208 via the conduit 216. For example, during an elevated demand or high load condition, an increased amount of air 303 is supplied to fuel nozzles 304, while a reduced amount of secondary air 306 flows into combustion chamber 314. Further, during a low load or turndown condition, a reduced amount of air 303 is supplied to the fuel nozzles 304 while an increased amount of secondary air 306 flows into combustion chamber 314. In particular, during the low load condition, the reduced amount of air 303 supplied to the fuel nozzles 304 enables a reduced amount of fuel 305 supplied to the nozzles without adversely affecting combustion. Specifically, the amount of air 303 for combustion with fuel 305 is reduced, thereby reducing carbon monoxide as a combustion byproduct. Further, improved flexibility for various turbine conditions, including combustion during turndown, is achieved by directing secondary air 306 without fuel into chamber 314. In addition, during a high load condition, the flow control device 218 may be restricted to reduce or shut off flow of secondary air 306 to the combustion chamber 314, thereby causing an increased supply of air 303 for combustion with fuel 305. Thus, the adjustable or variable air flow arrangement provides flexibility for operating conditions and improved efficiency.

FIG. 4 is a detailed sectional side view of another embodiment of a combustor 400. The combustor 400 includes a liner 401 disposed within a flow sleeve 402, wherein air 403 flows along the liner 401 to fuel nozzles 404. The air 403 is received by the fuel nozzles 404 and mixed with a fuel 405 flow. The amount of the air 403 supplied to the fuel nozzles 404 is adjusted by an amount of secondary air 406 flow, wherein the secondary air 406 is received from a plenum or chamber 410 between the flow sleeve 402 and an aft casing 412 (i.e., integral or non-integral aft casing). The secondary air 406 flows from the compressor discharge casing (e.g., 208, FIG. 2) of the turbine, which also supplies the air 403 to the fuel nozzles 404. The secondary air 406 flows through an inlet 420 in a flange 422 of the combustor 400. A flow control device 407, such as a rotary-type valve, controls the flow of secondary air 406 into a chamber 408 and then passage 409. The secondary air 406 flows from the passage 409 through injectors 414 into a combustion chamber 416. Exemplary injectors 414 and 312 (FIG. 3) are only in fluid communication with passages 409 and chamber 416 and passage 310 and chamber 314, respectively. Accordingly, the air flow 406, 306 directed through the injectors is only received from passages 409 and 310, respectively, and does not include fuel. Further, because the air flow 406, 306 is directed into the chambers downstream of combustion regions 418, 316 the air is not combusted As depicted, the passage 409 is an annular passage formed between two walls that make up the flow sleeve 402. The annular passage 409 enables air flow in a substantially axial direction in the combustor 400. When the flow control device 407 is open it receives the air 406 at a pressure, $P_3$, that is greater than a pressure, P4, in the combustion chamber, $P_4$, thus causing air flow from the chamber 410 through passage 409 into the combustion chamber 416, downstream of the combustion region 418. Accordingly, when the flow control device 407 is open, an amount of air 403 flowing to the nozzles 404 is reduced, such as during a turndown condition. During turndown (low load) condition, the reduced amount of air 403 for combustion with fuel 405 reduces carbon monoxide production as a combustion byproduct. Further, improved flexibility for various turbine conditions, including combustion during turndown, is achieved by directing secondary air 406 without fuel into combustion chamber 416. In addition, during a high load condition, the flow control device 407 may be restricted to reduce or shut off flow of secondary air 406 to the combustion chamber 416, thereby causing an increased supply of air 403 for combustion with fuel 405. In an embodiment, a position of the flow control device 407 enables flow from the chamber 410, wherein air 406 flow from the chamber 410 reduces an amount of an air flow into a transition piece (not shown) downstream of the combustor 400. The air 403 flow is supplied by the air from the transition piece, and is thus reduced or increased as the amount of air 406 flowing through flow control device 407 is increased or reduced, respectively.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A gas turbine engine comprising:

a combustor including a liner disposed within a flow sleeve;

a fuel nozzle, to which air flows through an annulus defined between the flow sleeve and the liner, the fuel nozzle being placed in an end of the combustor;

a passage defined between the flow sleeve and the annulus and configured to receive an air flow from a compressor discharge casing, wherein the passage directs the air flow from a first chamber coaxial with the fuel nozzle and into a second chamber disposed downstream of the first chamber and the fuel nozzle and wherein a chamber pressure is lower than a compressor discharge casing pressure; and a flow control device configured to control the air flow from the compressor discharge casing into the passage.

2. The gas turbine engine of claim 1, wherein the passage comprises an annular passage.

3. The gas turbine engine of claim 1, wherein the passage is configured to receive the air flow from the compressor discharge casing via a conduit external to the combustor.

4. The gas turbine engine of claim 1, wherein the passage is configured to receive the air flow from the compressor discharge casing via a chamber between the flow sleeve and a casing.

5. The gas turbine engine of claim 1, wherein the flow control device has an open position to enable substantially unrestricted air flow to the chamber at a turndown condition for the gas turbine engine and reduce an amount of air supplied to the fuel nozzle, thereby reducing carbon monoxide production from the gas turbine during the turndown condition.

6. The gas turbine engine of claim 5, wherein the flow control device has a closed position to substantially restrict air flow at a full load condition.

7. The gas turbine engine of claim 6, wherein an amount of air supplied to the fuel nozzle is increased when the flow control device is in the closed position.

8. The gas turbine engine of claim 1, wherein the air flow is directed into the chamber through the passage without fuel, wherein the air flow is not combusted when directed into the chamber.

9. A method for flowing air in a turbine engine including a combustor and a fuel nozzle, the combustor including a liner disposed within a flow sleeve, and the fuel nozzle being placed in a end of the combustor, the method comprising:

flowing air through an annulus defined between the flow sleeve and the liner;

receiving air in a passage defined between the flow sleeve and the annulus from a compressor discharge casing;

directing the air from a first chamber coaxial with the fuel nozzle, along the passage and into a combustion chamber disposed downstream of a combustion region in the combustion chamber and the fuel nozzle and; and controlling a flow of the air into the combustion chamber based on an operating condition of the turbine engine.

10. The method of claim 9, wherein directing the air comprises directing the air from a higher pressure in the compressor discharge casing to a relatively lower pressure in the chamber.

11. The method of claim 9, wherein receiving the air in the passage comprises receiving the air in the passage from a conduit external to a combustor.

12. The method of claim 9, wherein controlling the flow of air comprises positioning a flow control device in an open position to enable substantially unrestricted air flow to the combustion chamber at a turndown condition.

13. The method of claim 12, wherein an amount of air supplied to a fuel nozzle is reduced when the flow control device is in the open position, thereby reducing carbon monoxide production from the gas turbine during the turndown condition.

14. The method of claim 9, wherein controlling the flow of air comprises increasing the flow of air during a turndown condition and decreasing the flow of air during a full load condition.

15. The method of claim 9, wherein receiving the air in the passage from the compressor discharge casing comprises receiving the air from a chamber between the flow sleeve and a casing.

16. A gas turbine engine comprising a compressor including a liner disposed within a flow sleeve;

a turbine;

a fuel nozzle, to which air flows through an annulus defined between the flow sleeve and the liner, the fuel being placed in an end of a combustor;

a combustion chamber in fluid communication with a compressor discharge casing having a first pressure, wherein the combustion chamber has a second pressure, wherein a difference in pressure between the first and second pressure directs an air flow from a first chamber coaxial with the fuel nozzle and into the combustion chamber downstream of the fuel nozzle via a passage defined between the flow sleeve and the annulus; and a flow control device configured to control the air flow from the compressor discharge casing to the combustion chamber, wherein the flow control device has an open position to enable substantially unrestricted air flow to the chamber at a turndown condition on and a closed position to substantially restrict air flow at a full load condition.

17. The gas turbine of claim 16, wherein the air flow is directed into the combustion chamber without fuel.

* * * * *